US007354221B2

(12) United States Patent
Congdon

(10) Patent No.: US 7,354,221 B2
(45) Date of Patent: Apr. 8, 2008

(54) SELF-PROPELLED PLATE COMPACTOR HAVING LINEAR EXCITATION

(75) Inventor: Thomas M. Congdon, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 132 days.

(21) Appl. No.: 11/067,275

(22) Filed: Feb. 28, 2005

(65) Prior Publication Data

US 2006/0193693 A1 Aug. 31, 2006

(51) Int. Cl.
*E01C 23/07* (2006.01)

(52) U.S. Cl. ..... 404/84.1; 404/133.05; 404/133.1

(58) Field of Classification Search ..... 404/84.05, 404/84.1, 114, 133.05, 133.1
See application file for complete search history.

(56) References Cited

U.S. PATENT DOCUMENTS

| | | | | |
|---|---|---|---|---|
| 3,603,224 | A | 9/1971 | Dresher | |
| 3,899,263 | A | 8/1975 | Briggs et al. | |
| 3,972,637 | A | 8/1976 | Sutherland | |
| 4,113,403 | A | 9/1978 | Tertinek et al. | |
| 4,382,715 | A * | 5/1983 | Vural et al. | 404/133.05 |
| 4,771,645 | A | 9/1988 | Persson | |
| 4,966,499 | A | 10/1990 | St. Louis | |
| 5,149,225 | A | 9/1992 | Artzberger | |
| 5,320,448 | A | 6/1994 | Artzberger | |
| 5,387,052 | A | 2/1995 | Artzberger | |
| 5,439,314 | A | 8/1995 | Wadensten | |
| 5,672,027 | A | 9/1997 | Wadensten | |
| 5,957,622 | A | 9/1999 | Vera-Montiel | |
| 6,227,760 | B1 | 5/2001 | Togami et al. | |
| 6,293,729 | B1 | 9/2001 | Greppmair | |
| 6,435,767 | B1 * | 8/2002 | Steffen | 404/133.1 |
| 6,742,960 | B2 | 6/2004 | Corcoran et al. | |
| 6,846,128 | B2 * | 1/2005 | Sick | 404/133.05 |
| 2004/0020306 | A1 | 2/2004 | Moscrip et al. | |

FOREIGN PATENT DOCUMENTS

| | | | |
|---|---|---|---|
| DE | 41 11 284 | * | 9/1993 |
| FR | 2 517 569 | * | 6/1983 |
| GB | 1 502 361 | * | 3/1978 |
| JP | 9-242014 | * | 9/1997 |

OTHER PUBLICATIONS

Ammann ARC 1000 Overview printed from http://amman-group.de/product_detail.php?id-5 on Jan. 20, 2005.
Ammann AVH 1000 TC Brochure, dated Mar. 2003.

* cited by examiner

*Primary Examiner*—Gary S Hartmann
(74) *Attorney, Agent, or Firm*—Finnegan, Henderson, Farabow, Garrett & Dunner

(57) ABSTRACT

The present disclosure is directed to a vibratory plate compactor, having at least one contact plate configured to be vibrated. The compactor may also include one or more excitation devices configured to vibrate the at least one contact plate. The compactor may further include a power system configured to supply power to the one or more excitation devices. In addition, the one or more excitation devices may be configured to generate linear excitation of the at least one contact plate to compact material beneath the at least one contact plate, propel the compactor, and steer the compactor. Steering and propulsion may be accomplished by varying the angle of the axis of excitation relative to the contact plate.

35 Claims, 6 Drawing Sheets

SELF-PROPELLED PLATE COMPACTOR HAVING LINEAR EXCITATION

TECHNICAL FIELD

The present disclosure is directed to a vibratory plate compactor and, more particularly, to a self-propelled plate compactor having linear vibratory excitation.

BACKGROUND

Vibratory compactors may include a plate or roller that is oscillated or vibrated to impose compaction forces on a densifiable strata, such as ground soil, roadway base material, or paving material. In some instances, an engine or hydraulic motor controllably rotates at least one eccentric mass to impart vibratory motion at a particular frequency to the surface contacting plate or roller member. The result is an oscillatory force with the frequency of the speed of rotation, and an amplitude dependent on the mass eccentricity and speed of rotation. Variations on this basic system include multiple eccentric weights and/or shafts such that by changing the phasing of the multiple weights and/or shafts, the degree of force created by the eccentric masses can be varied. Other systems may include masses that are linearly oscillated to create linear excitation of the surface contacting plate or roller drum. Linear excitation may also be created along a particular axis by rotating eccentric mass systems with the use of counter-rotating masses to counteract off-axis vibrations.

In roller-type compactors, propulsion may be provided by simply driving the roller drums like wheels. In plate compactors, the angle of the compaction forces relative to the stratum may be changed to propel the compactor itself. That is, the same energy that is used to compact the stratum may be used to propel the compactor. Once the stratum is compacted to a certain degree, the surface of the stratum will no longer move significantly downward under the force of the vibrations (i.e., the stratum will not significantly compact). Instead, the compaction forces will have the effect of lifting the compactor by pushing off the now-firm stratum. By angling the vibratory energy at a non-perpendicular angle relative to the surface of the stratum, the compaction forces may have the effect of propelling the compactor along the stratum.

While roller-type compactors may utilize less sophisticated forms of vibratory excitation (because the vibratory energy need not be used for propulsion), the rollers may, in the process of compaction, manipulate the densifiable strata to the detriment of the finished stratum. For example, rolling a drum over an uncompacted stratum can create a "bow-wave." A bow-wave is an upward bulging of the material in front of the roller drum. Bow-wave is the result of the radius of curvature (i.e., diameter) of the roller drum, which may create a tendency for the drum to plow the uncompacted material. The Nijboer quotient describes the tendency of a roller to push or plow material in front of it. The Nijboer quotient may be calculated with the following formula.

$$N = \frac{\text{Axle Load}}{(\text{Drum width}) * (\text{Drum Diameter})}$$

With paving material, a bow-wave can create cracking in the paving material. This cracking may render the finished pavement with a reduced structural integrity and/or decreased durability.

Although certain conditions may prevent and/or repair the cracking (e.g., sufficient heat in the strata), adequate control of these conditions may be difficult. In view this limitation of roller-type compactors, a plate compactor may provide superior compaction with little or no risk of bow-wave because it has an infinite radius of curvature (see Nijboer quotient formula above, which depends on drum diameter). A plate compactor simply compresses the stratum downward with little or no tendency to plow the material in front of the plate.

An additional advantage of plate compactors over roller-type compactors is that, when stationary, plate compactors are less likely to sink into a stratum. A plate compactor spreads its weight more over a stratum so it will not be as likely to sink (e.g., into freshly-laid asphalt, which may still be warm and, therefore, soft) as would the rollers of a roller-type compactor. Rollers may have contact patches that are not as large relative to the size and weight of the machine as those of a plate compactor.

Historically, large scale compactors (e.g., for highway construction) have been limited to roller-type compactors due to the logistics of moving a plate compactor of that size and the lack of maneuverability of available plate compactors. The benefits of a plate compactor (e.g., no bow-wave) may not have outweighed the obstacle of maneuverability.

Some plate compactors have made use of linear excitation for various benefits (e.g., compaction controllability, energy efficiency, etc.), but have not employed the linear excitation for purposes of propulsion. For example, U.S. Pat. No. 6,293,729, issued to Greppmair on Sep. 25, 2001 (the '729 patent), discloses a plate compactor that uses linear excitation. The '729 patent, however, does not disclose that the excitation is used to propel the compactor itself. Rather, the device of the '729 patent includes one or more sets of wheels, which may be driven to provide propulsion for the compactor.

The present disclosure is directed toward solving one or more problems set forth above.

SUMMARY OF THE INVENTION

In one aspect, the present disclosure is directed to a vibratory plate compactor having at least one contact plate configured to be vibrated. The compactor may also include one or more excitation devices configured to vibrate the at least one contact plate. The compactor may further include a power system configured to supply power to the one or more excitation devices. In addition, the one or more excitation devices may be configured to generate linear excitation of the at least one contact plate to compact material beneath the at least one contact plate, propel the compactor, and steer the compactor.

In another aspect, the present disclosure is directed to a method of compacting a stratum, including controlling one or more excitation devices to generate linear excitation of at least one contact plate of a compactor against a surface of the stratum. The method may further include compacting the stratum with vibratory energy created by the linear excitation, as well as propelling and steering the compactor with the vibratory energy by controlling a pitch angle of the linear excitation of at least one of the one or more excitation devices relative to the at least one contact plate.

DETAILED DESCRIPTION

Reference will now be made in detail to the drawings. Wherever possible, the same reference numbers will be used throughout the drawings to refer to the same or like parts.

Figure 1:
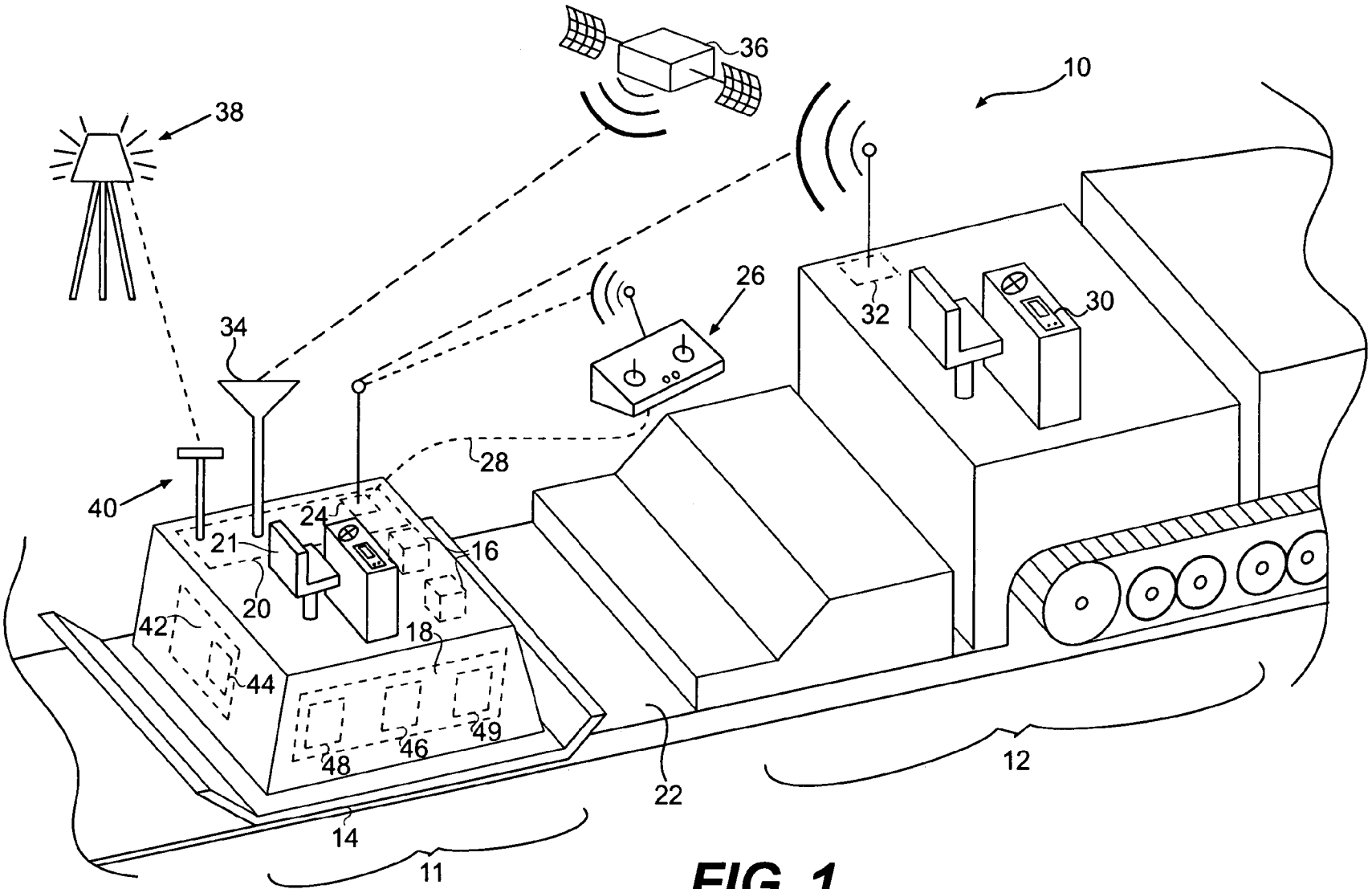
FIG. 1 is a diagrammatic illustration of a paving system according to an exemplary disclosed embodiment.

FIG. 1 illustrates a paving system 10, including a plate compactor 11 following behind a paving machine 12. Compactor 11 may include at least one contact plate 14, one or more excitation devices 16 configured to actuate contact plate 14 to produce vibration. Compactor 11 may include a power system 18 configured to supply power to excitation devices 16 and a controller 20 configured to control operation of excitation devices 16. Certain embodiments may include an operator station 21 configured to accommodate a riding operator.

While paving machine 12 is shown to illustrate the possibility of using compactor 11 in conjunction with a paving machine, compactor 11 may be used independently to compact a variety of densifiable strata. For purposes of discussion, however, compactor 11 will be primarily discussed with regard to compacting a stratum of paving material. In such case, compactor 11 may be operated in close conjunction with paving machine 12 as it lays down an uncompacted stratum 22 of paving material.

Compactor 11 may be configured to be remotely controlled. To facilitate such remote operation, compactor 11 may include a signal receiver 24 to pick up remote control signals from a transmitting input device 26. Input device 26 may be of any configuration, such as a hand-held remote control unit as shown in FIG. 1. Input device 26 may be configured to transmit any type of signals, such as radio signals, infrared signals, or any other type of over-the-air transmission signals. Signal receiver 24 may be configured to receive these signals and relay them to controller 20. Alternatively or additionally, remote control signals may be transmitted to compactor 11 via an umbilical cable 28, which may connect compactor 11 with input device 26.

In one embodiment, compactor 11 may be remotely controlled by a paving machine operator while operating a paving machine. In such an embodiment, paving machine 12 may include a set of paver-mounted compactor controls 30 for operating compactor 11 remotely. Paving machine 12 may generate control signals in response to inputs made to paver-mounted compactor controls 30. A paver-mounted transmitting device 32 may transmit these signals to compactor 11.

Compactor 11 may be configured to operate autonomously. That is, compactor 11 may be configured to automatically compact, travel, and/or maneuver. For example, compactor 11 may be configured to automatically follow the path of travel of paving machine 12 as shown in FIG. 1. In one embodiment, operating parameters of compactor 11 may be automatically controlled based on operating parameters of paving machine 12. For example, control inputs made to propel paving machine 12 may also cause a corresponding propulsion of compactor 11. Paver-mounted transmitting device 32 may be configured to transmit a signal, such as those discussed above, to compactor 11.

Alternatively or additionally, autonomously operating embodiments of compactor 11 may operate automatically under the guidance of a positioning system. As such, compactor 11 may also include various types of positioning and/or guidance system equipment. For example, compactor 11 may include one or more global positioning system (GPS) receivers 34 configured to receive positional information from at least one satellite 36. Alternatively or additionally, compactor 11 may include components of a laser-based positioning system such as a laser transmitter 38 and a laser receiver 40. By using a positioning system to determine the position and movement of compactor 11 in a worksite, compactor 11 may be controlled to follow a predetermined path and compact in a predetermined manner at predetermined locations along the path.

Also, a positioning system may enable compactor 11 to automatically follow paving machine 12 as it lays down a fresh stratum of asphalt. For example, using a GPS or laser-based positioning system, the position and/or travel of paving machine 12 may be tracked, and compactor 11 may be automatically controlled to follow the same course as paving machine 12. Similarly, radio signals from paving machine 12 may transmit operational information about paving machine 12 (e.g. speed, direction, etc.). Compactor 11 may base its operation (e.g., path of travel) on this information received from paving machine 12.

Compactor 11 may also include a compaction monitoring system 42. Compaction monitoring system 42 may be used to determine whether and when a stratum has reached a predetermined level of compaction. This determination may be used to manually or automatically adjust one or more operating parameters to optimize compaction performance and or propulsion. For example, parameters such as vibratory frequency and amplitude, as well as rate of travel, etc. may be adjusted to alter compaction performance. In one embodiment, compactor 11 may be configured to automatically adjust one or more operating parameters in response to information from compaction monitoring system 42. For example, compactor 11 may be desired to completely compact a stratum in a single pass. In such case, if insufficient compaction is detected, then one or more adjustments may be made manually or automatically, such as slowing the rate of travel of compactor 11, increasing the amplitude of the vibrations, etc.

In one embodiment, the compaction monitoring system may include an accelerometer 44 configured to monitor the acceleration of contact plate 14. Vibratory motion of contact plate 14 may compress stratum 22 with each vibratory pulse. As stratum 22 becomes more compacted, it may compress less and less with each pulse. Therefore, the vibratory motion of contact plate 14 may be decelerated more rapidly when vibrating against a firm, compacted surface because the surface has less give to it than would an uncompacted surface. Further, compactor 11 may begin to "hop" (i.e., bounce off the surface of the stratum) as the stratum becomes more compacted because a compacted stratum will be firm and, rather than compress the stratum, the vibratory pulses may push off the stratum causing compactor 11 to hop. Accelerometer 44 may be configured to monitor the acceleration of contact plate 14 to determine a rate of deceleration of the contact plate during each pulse and/or to determine if compactor 11 is hopping as described above.

Power system 18 may include a power source 46, such as an internal combustion engine (e.g., a diesel, gasoline, natural gas, or hydrogen engine), a gas turbine engine, one or more batteries, combinations of these types of power sources (e.g. a hybrid), or any other suitable type of power source. In certain embodiments, power system 18 may also include an electric generator 48, which may be driven by power source 46 and may be configured to produce electrical energy. This electrical energy may be used for any purpose, such as, for example, powering excitation devices 16. Power system 18 may also include a hydraulic motor 49 configured to power excitation devices 16.

Controller 20 may be configured to receive control signals and/or information from various input sources and control one or more operating parameters of compactor 11. For example, controller 20 may receive control signals from input device 26, whether by radio transmission signals or hardwired umbilical cable 28. Controller 20 may also receive information from positioning system components, such as GPS receiver 34. Based on this received information, controller 20 may regulate operation of excitation devices 16, including parameters such as vibration frequency and amplitude, as well as propulsion and/or steering of compactor 11.

Figure 2C:
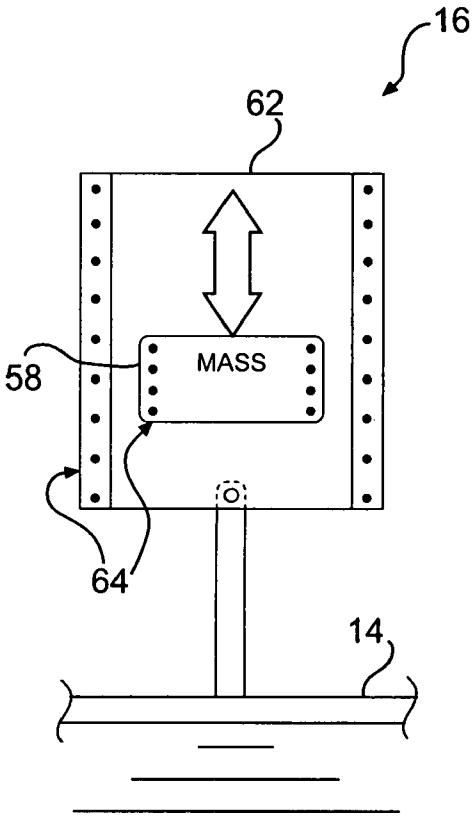
FIG. 2C is a diagrammatic illustration of an electromagnetic linear actuator excitation device according to an exemplary disclosed embodiment.

Vibration of contact plate 14 may be created with a variety of different kinds of excitation devices 16. FIG. 2A illustrates one possible type of excitation device 16 having rotating eccentric weights 50. Weights 50 may be connected to contact plate 14. As weights 50 rotate, they may create vibration that may be transmitted to contact plate 14. By providing excitation devices 16 with counter-rotating eccentric weights 52, the vibration may be rendered linearly along an axis 54, as the off-axis vibrations are cancelled by the counter-rotation of weights 50 and weights 52.

Figure 2B:
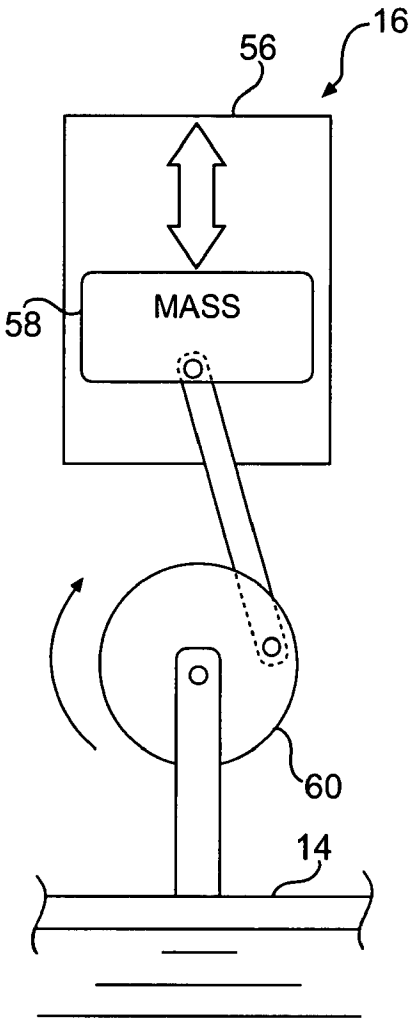
FIG. 2B is a diagrammatic illustration of a linear actuator excitation device according to an exemplary disclosed embodiment.
Figure 2A:
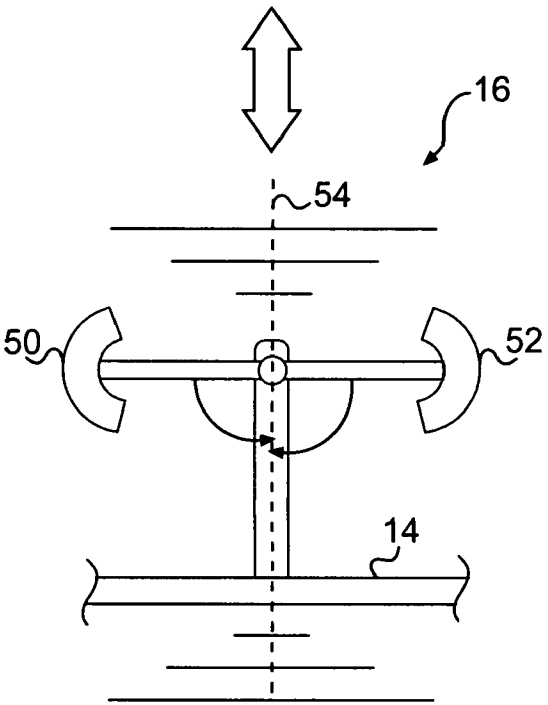
FIG. 2A is a diagrammatic illustration of a rotating mass excitation device according to an exemplary disclosed embodiment.

FIG. 2B illustrates an alternative embodiment wherein the excitation device may include a linear actuator 56. The embodiment shown in FIG. 2B may include a linearly oscillating mass 58. Mass 58 may be connected to an eccentric portion of a rotating crankshaft 60. Crankshaft 60 may be driven by power source 46, electric generator 48, and/or hydraulic motor 49. Rotation of crankshaft 60 may cause mass 58 to oscillate. The inertia of mass 58 as it oscillates may result in linear vibrations, which may be transmitted to contact plate 14.

FIG. 2C illustrates a further alternative embodiment wherein the excitation devices 16 may include a linear actuator 62. As in FIG. 2B, mass 58 may be linearly oscillated. In this embodiment, however, the oscillation of mass 58 may be generated by one or more electromagnets 64.

Figure 3:
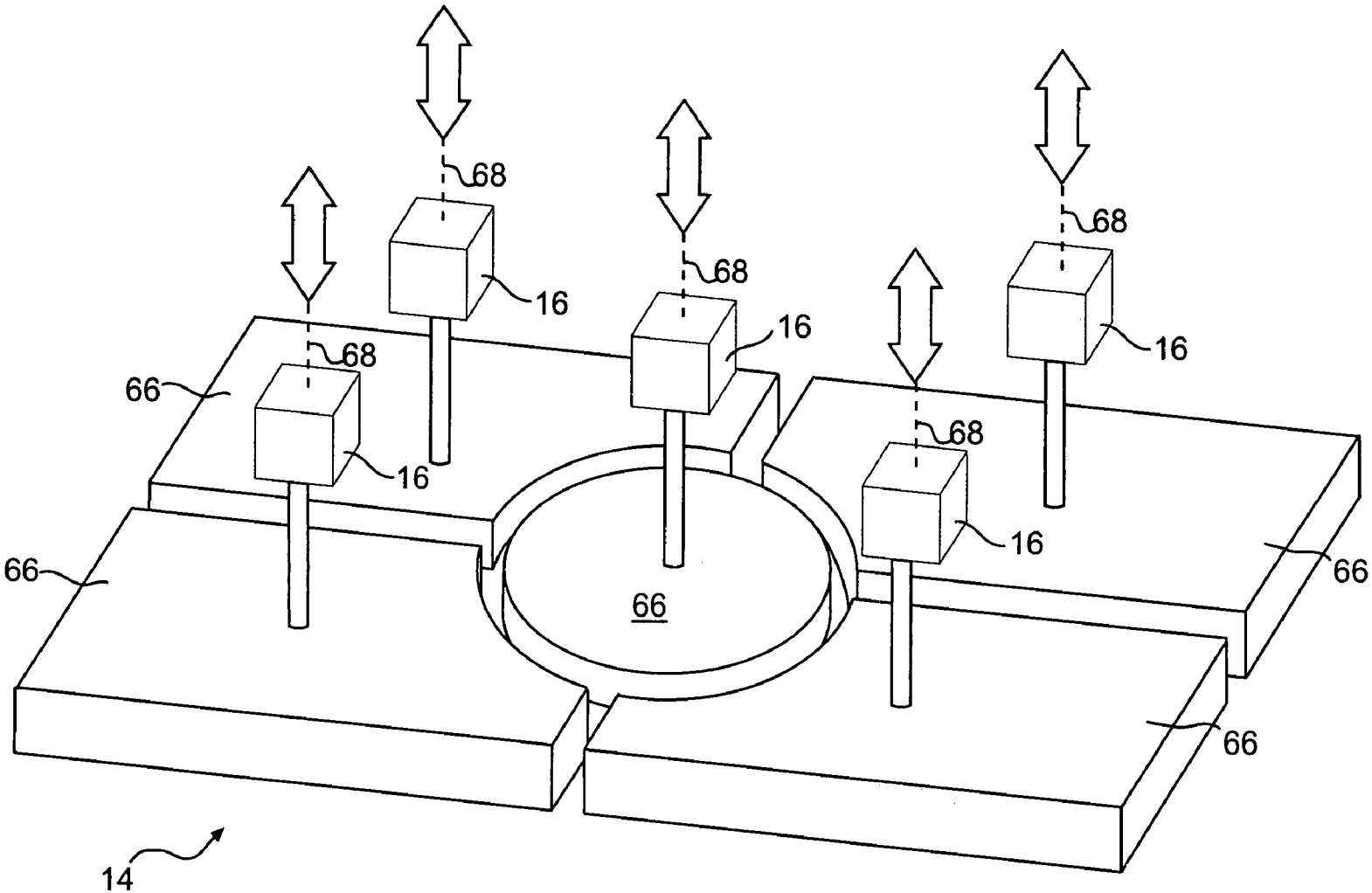
FIG. 3 is a diagrammatic illustration of multiple contact plates of a plate compactor and excitation devices associated therewith according to an exemplary disclosed embodiment.

As illustrated in FIG. 3, contact plate 14 may be separated into two or more separate contact plates 66, each individually excitable by one or more excitation devices 16. Excitation devices 16 may generate linear excitation of contact plates 66. That is, excitation devices 16 may impart linear vibratory forces on each of contact plates 66 at the points of contact between excitation devices 16 and contact plates 66. Such linear vibratory forces may each be in a direction axial with axes 68 rather than in all directions. As shown in FIG. 3, axes 68 of linear vibration may be substantially normal to contact plates 66.

Figure 4:
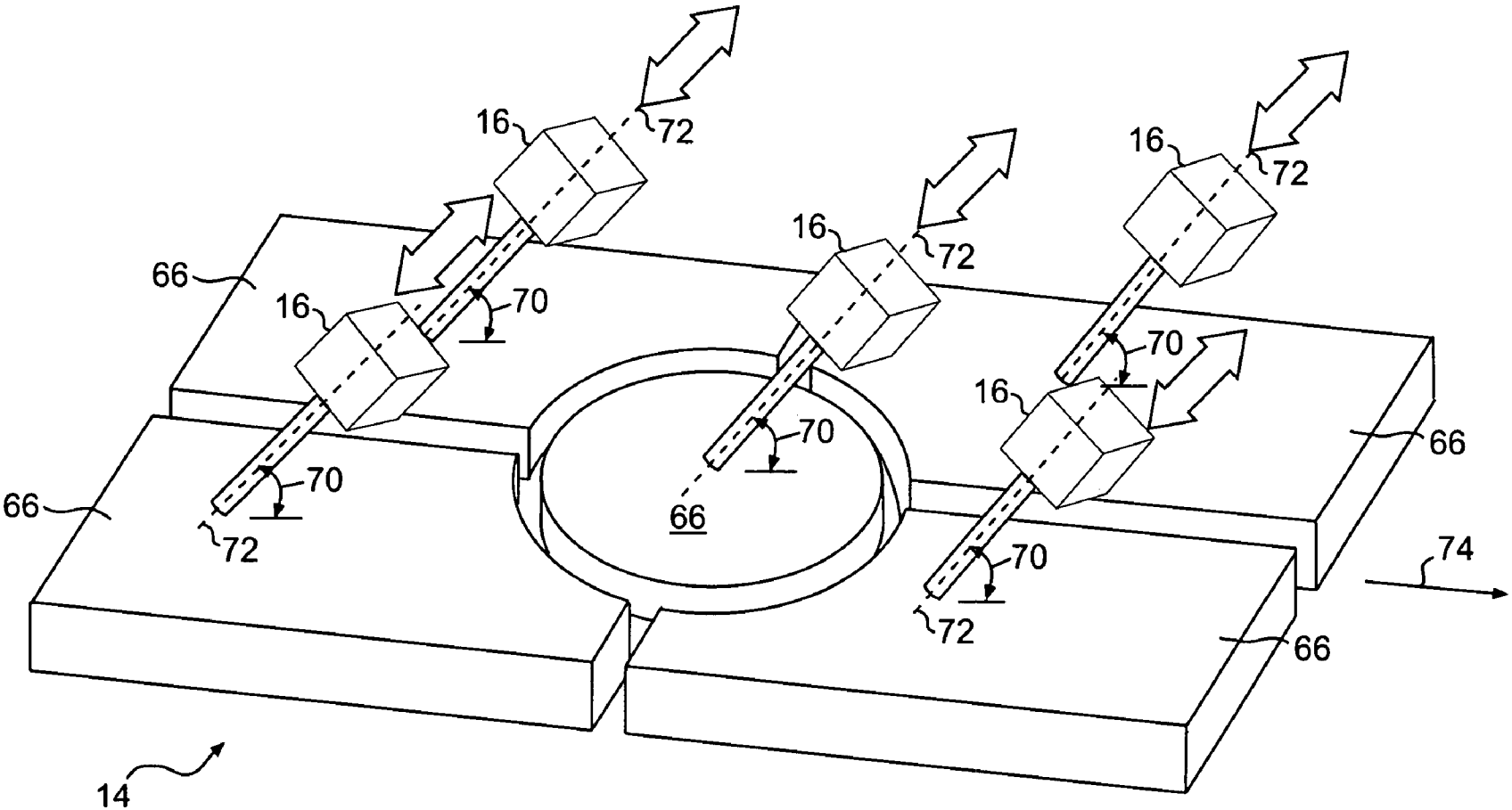
FIG. 4 is a diagrammatic illustration of multiple contact plates of a plate compactor and excitation devices associated therewith during propulsion of the compactor according to an exemplary disclosed embodiment.

FIG. 4, however, illustrates tilting of excitation devices 16 at pitch angles 70 relative to contact plates 66 so as to create linear excitation of contact plates 66 along axes 72 that are angled relative to contact plates 66, thereby allowing compactor 11 to be propelled in a direction indicated by an arrow 74. Once a stratum is compacted by compactor 11, the surface of the stratum may become firm. Excitation generated at non-normal pitch angles may propel compactor 11 over the surface of the stratum by pushing off the firm stratum obliquely rather than straight up and down. Pitch angles 70 of excitation devices 16 may be variable in order to maneuver compactor 11. For example, excitation devices 16 may be angled forward or backward to propel compactor forward or backward. Further, excitation devices 16 may be omni-directionally angled. That is, they may be angled forward, rearward, side-to-side, or any combination thereof. For example, synchronous angling of excitation devices 16 forward and to the right may propel compactor 11 forward and to the right.

Figure 5:
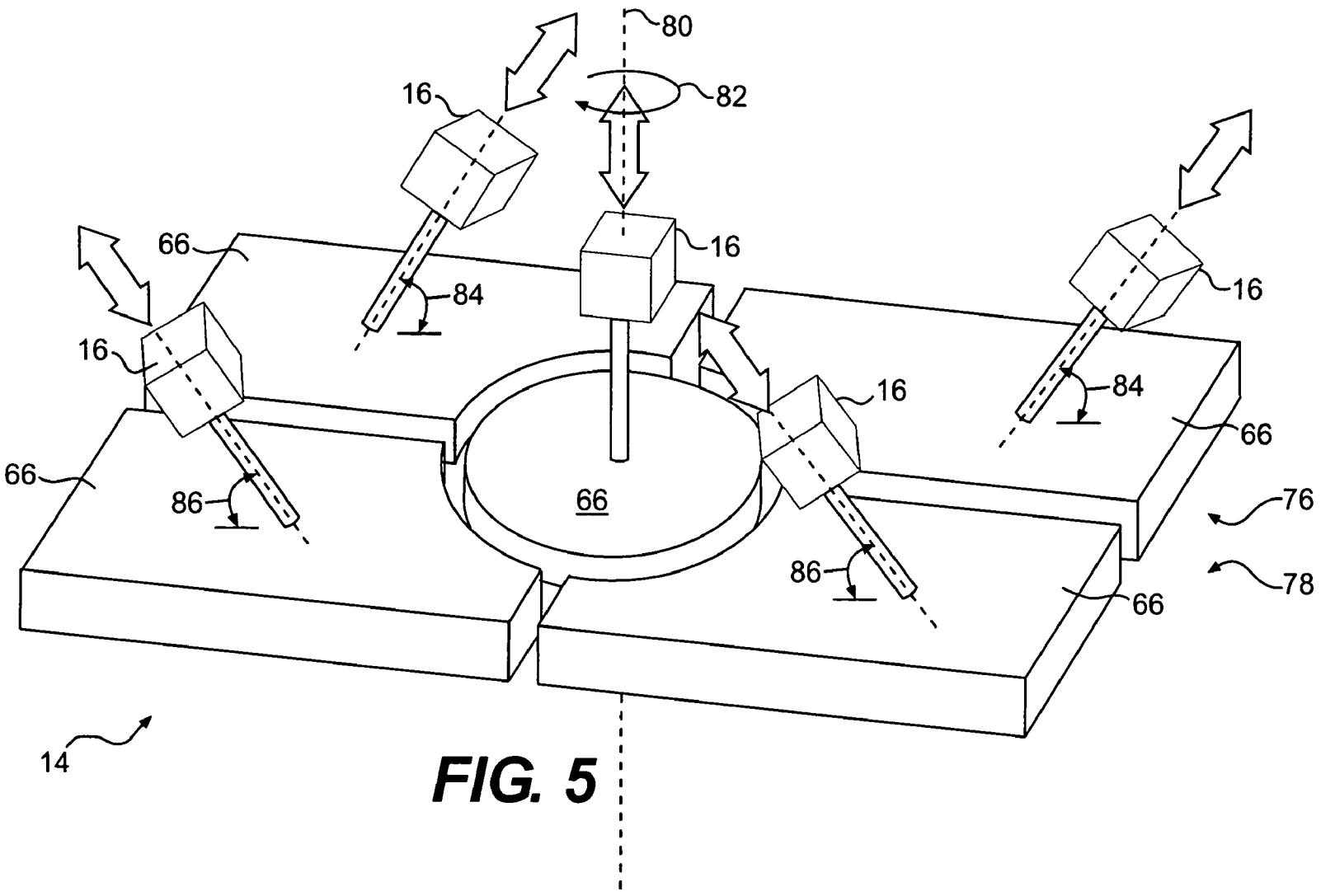
FIG. 5 is a diagrammatic illustration of multiple contact plates of a plate compactor and excitation devices associated therewith during steering of the plate compactor according to an exemplary disclosed embodiment.

While excitation devices 16 may be all positioned at the same pitch angle 70, they may be individually controlled to provide even greater maneuverability, steerability, and/or improved compaction. For example, FIG. 5 illustrates one possible method of steering compactor 11. By angling excitation devices on a first side 76 of compactor 11 in one direction, and angling excitation devices on a second side 78 of compactor 11 in the opposite direction, compactor 11 may be steered. Compactor 11 may be turned about an axis of rotation 80 in a direction indicated by an arrow 82, if a first side pitch angle 84 is substantially equal but opposite to a second side pitch angle 86. That is, compactor 11 may be made to perform a "zero-radius" turn. If first side pitch angle 84 is different than second side pitch angle 86, then compactor 11 may be made to do a "radiused" turn. That is, while traveling in one direction, compactor 11 may be made to curve varying degrees to one side or the other.

Tilting of excitation devices 16 may be accomplished in any suitable manner. For example, one or more actuators (not shown) may be employed to move the upper portions of excitation devices 16 while the lower portions remain attached to contact plate 14 (e.g., via a hinge or ball joint). Such actuators may be driven electrically, mechanically, and/or hydraulically. For example, such actuators may include servo motors, hydraulic motors, stepper motors, etc. Further, two or more of excitation devices 16 may be configured to tilt at the same or corresponding angle to one another. Such a configuration may be facilitated by a mechanical linkage (not shown). Alternatively, an electrical configuration may be utilized where one of excitation devices 16 may be positioned by one or more master actuators. Controller 20 may be configured to command slave actuators of one or more other excitation devices 16 to position the other excitation devices at the same or corresponding angle as the master actuators.

Figure 6:
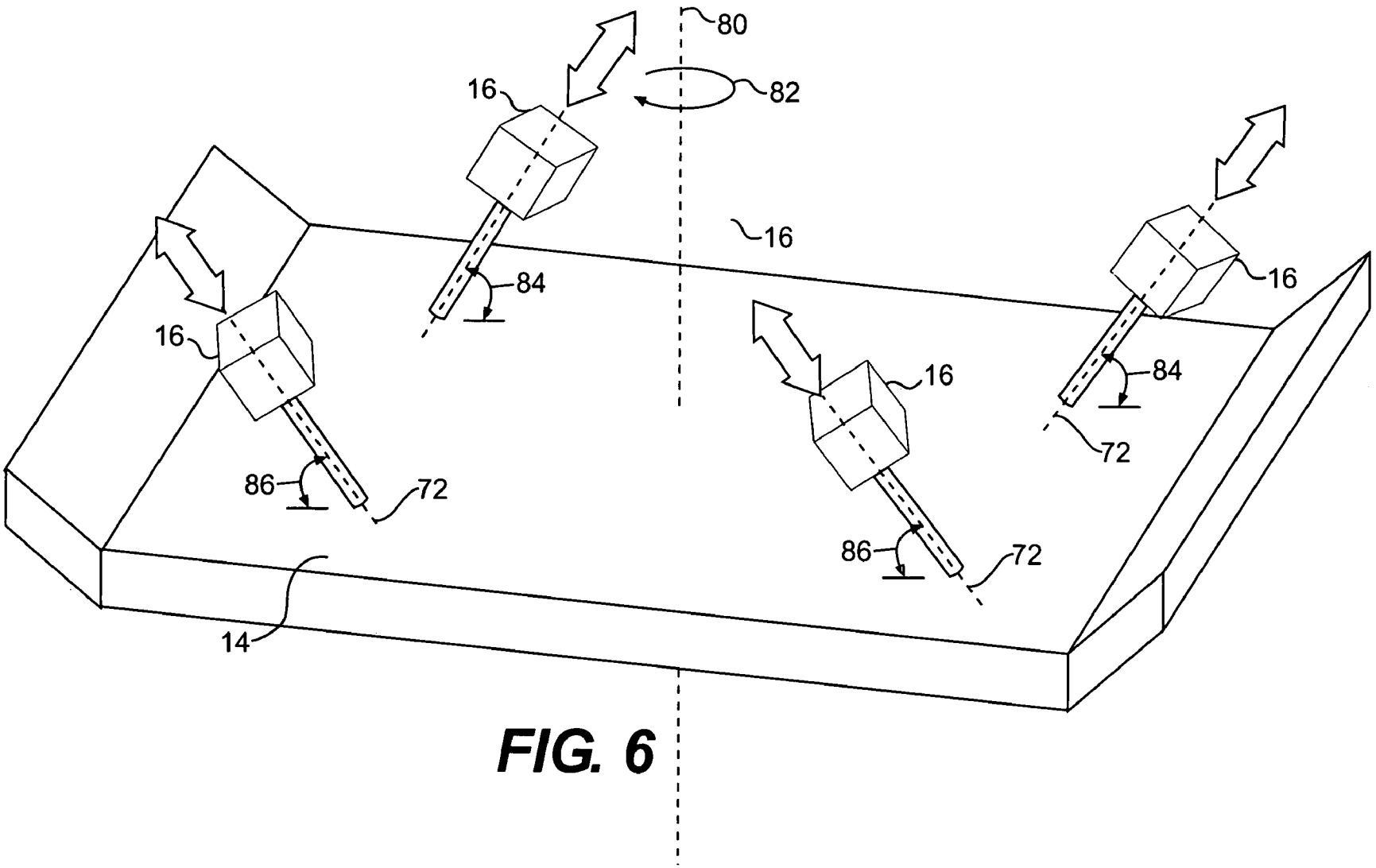
FIG. 6 is a diagrammatic illustration of a plate compactor having a single contact plate configuration and excitation devices associated therewith during steering of the plate compactor according to an exemplary disclosed embodiment.

FIG. 6 illustrates an embodiment having a single contact plate 14, configured to be actuated by two or more excitation devices 16. Despite having a single contact plate 14, the embodiment shown in FIG. 6 may be self-propelled, maneuverable, and steerable as discussed with regard to FIGS. 3-5. Different portions of contact plate 14 may be excited linearly along axes 72 at different pitch angles. For example, as with the multiple plate embodiment shown in FIG. 5, the single plate embodiment in FIG. 6 may have excitation devices on one side of compactor 11 positioned at first side pitch angle 84, which may be opposite second side pitch angle 86.

Excitation devices 16 may also be individually controlled for frequency, amplitude, and phase. For example, it may be desirable to operate excitation devices 16 toward the front of compactor 11 with a different frequency and/or amplitude than those at the rear of compactor 11. This flexibility may enable improved optimization of compaction and propulsion. For example, a given strata material may be optimally compacted with a particular frequency and amplitude of excitation, but propulsion may be optimally created at a different frequency and amplitude of excitation. In such case, excitation devices toward a leading edge of compactor 11 could be excited at a frequency and amplitude better suited for compaction and excitation devices toward a trailing edge of compactor 11 may be excited at a frequency and amplitude better suited for propulsion, because the stratum would already be compacted by the excitation at the leading edge of compactor 11.

The phase of the excitation may also be controlled. For example, in certain circumstances, excitation devices 16 may be operated at frequencies that are harmonically matched to the natural resonant frequency of the compactor chassis itself. This may provide a natural amplification of the excitation. In other circumstances, excitation devices 16 may be operated at frequencies that are not harmonically matched and/or out of phase with the natural resonance of the compactor chassis. Operation of excitation devices 16 at frequencies that are not harmonically matched and/or opposite the natural resonant frequency of the compactor chassis may provide a natural cancellation of at least some of the vibratory energy.

INDUSTRIAL APPLICABILITY

Compactor 11 may be used to compact any densifiable strata including, for example, asphalt, loose aggregate such as gravel and sand, natural soil, or any other compactable material. Compactor 11 may be used independently or in conjunction with a stratum-spreading device. For example, compactor 11 may be used in close conjunction with and/or may be controlled from or by a paving machine.

Compactor 11 may be configured for single pass compaction. That is, compactor 11 may be configured to completely compact a stratum in a single pass rather than with multiple passes as may be required with a roller-type compactor. This single pass capability may enable compactor 11 to simply follow behind a stratum-spreading device resulting in a finished surface with a single pass.

Compactor 11 may be of any suitable size. Compactor 11 may be a small unit suitable for use in trenches, a medium sized machine suitable for compaction within large building footprints, a large size machine suitable for highway construction, or any size in between. Large size units may be configured to compact a full width of a roadway lane in a single pass.

Because compactor 11 may utilize linear excitation, and the pitch angles of that linear excitation may be adjusted, compactor 11 may have a large amount of operational efficiency and/or flexibility. For example, linear excitation may be more energy efficient than non-linear excitation because little or no energy is wasted generating off-axis vibrations that do not impart compactive forces on the stratum. Further, the steerability of compactor 11 achieved by variations in pitch angle provide compactor 11 with significant maneuverability. The use of linear excitation to propel compactor 11, along with this steerability, may facilitate movement of compactor 11 around a worksite. In addition, the mobility of compactor 11 may be augmented by one or more deployable wheels (not shown) which may or may not be driven.

This mobility may enable compactor 11 to be larger than existing plate compactors, while still remaining practical to move about a worksite.

Certain embodiments may be large enough to compact a full width of a stratum laid down by a highway paving machine. Highway paving machines can have paving widths of about 8-10 feet, and may sometimes be extendable to yield a stratum that is wider still. Compactor 11 may be wide enough to compact a stratum with a width of at least about 8-10 feet in a single pass. That is, contact plate 14 may have a width of about 8-10 feet or more.

In addition, pitch angles of linear excitation may be adjusted omni-directionally, which may enable compactor 11 to not only be turned and propelled forward and backward, but also be propelled side to side or at any angle in between. Further, linear excitation may be generated by linear actuators, which may enable these pitch angles to be adjusted more easily. For example, the linear actuators may include electromagnets rather than a rotating shaft. Without a shaft, the actuators may be more easily tilted and turned to provide varying pitch angles.

Compactor 11 may be provided with a significant amount of versatility. While compactor 11 may include features that make large-sized versions feasible, such features remain applicable and, in some cases, beneficial to small-sized versions. Additional flexibility may also be provided by the compactor's ability to vary vibration amplitude, frequency, and phase. Variation of these parameters may enable compactor 11 to tailor its operation for compacting various strata and/or for propelling and steering compactor 11.

This flexibility in compaction capabilities may also enable compactor 11 to be configured to compact various strata with a single pass. That is, compactor 11 may be configured to completely compact a stratum in a single pass. For purposes of this disclosure, complete compaction may include compaction of a level that meets a specification established by any set of private or governmental guidelines and/or requirements. For example, a particular state government may suggest or require that a stratum of paving material having given parameters (e.g., type of material, thickness of stratum, temperature, etc.) be compacted to a predetermined quantifiable specification (e.g., density). While existing compactors, such as roller-type compactors may need to make several passes to achieve complete compaction, compactor 11 may be configured to provide all suggested and/or required compaction in a single pass.

It will be apparent to those having ordinary skill in the art that various modifications and variations can be made to the disclosed self-propelled plate compactor having linear excitation without departing from the scope of the invention. Other embodiments of the invention will be apparent to those having ordinary skill in the art from consideration of the specification and practice of the invention disclosed herein. It is intended that the specification and examples be considered as exemplary only, with a true scope of the invention being indicated by the following claims and their equivalents.

I claim:

1. A vibratory plate compactor, comprising:

at least one contact plate configured to be vibrated;

one or more excitation devices configured to vibrate the at least one contact plate; and a power system configured to supply power to the one or more excitation devices;

the one or more excitation devices being configured to generate linear excitation of the at least one contact plate to compact material beneath the at least one contact plate, propel the compactor, and steer the compactor;

wherein the one or more excitation devices include one or more linear actuators.

2. The compactor of claim 1, wherein the one or more linear actuators include one or more electromagnetic actuators.

3. The compactor of claim 2, wherein the power system includes an electric generator configured to create electrical energy to power the one or more electromagnetic actuators.

4. The compactor of claim 1, wherein the one or more linear actuators include one or more linearly oscillating masses and one or more crankshafts associated with the one or more linearly oscillating masses.

5. The compactor of claim 1, further including a hydraulic motor configured to drive the one or more excitation devices.

6. The compactor of claim 1, wherein the compactor is configured to be propelled by varying a pitch angle between an axis of linear excitation and the at least one contact plate.

7. The compactor of claim 6, wherein the at least one contact plate includes at least two contact plates, each of the at least two contact plates being configured to be vibrated by at least one excitation device.

8. The compactor of claim 7, further including a controller configured to individually control at least one of the pitch angle, an amplitude of excitation, and a frequency of excitation for at least one of the one or more excitation devices.

9. The compactor of claim 7, wherein the one or more excitation devices includes at least two excitation devices, and wherein the controller is configured to individually control at least one of the pitch angle, an amplitude of excitation, and a frequency of excitation for each of the at least two excitation devices.

10. The compactor of claim 7, wherein the compactor is configured to perform a zero-radius turn.

11. The compactor of claim 7, wherein the at least one contact plate includes at least four contact plates, each positioned at a corner of the compactor.

12. The compactor of claim 6, further including a compaction monitoring system to determine whether a predetermined amount of compaction has been achieved.

13. The compactor of claim 12, wherein the compaction monitoring system includes at least one accelerometer configured to detect acceleration of the at least one contact plate upon exerting a vibratory force against a surface of a stratum.

14. The compactor of claim 1, further including a controller configured to control at least one of a frequency and an amplitude of excitation generated by the one or more excitation devices.

15. The compactor of claim 1, further including at least two excitation devices, each excitation device being independently controllable for at least one of frequency, amplitude, and phase.

16. The compactor of claim 1, wherein the at least one contact plate includes two or more separate plates, each individually excitable by at least one of the one or more excitation devices.

17. The compactor of claim 1, wherein a pitch angle of at least one of the one or more excitation devices between an axis of linear excitation and the at least one contact plate is variable to steer the compactor.

18. The compactor of claim 17, wherein the pitch angle of each excitation device is individually variable.

19. A method of compacting a stratum, comprising:

controlling one or more excitation devices to generate linear excitation of at least one contact plate of a compactor against a surface of the stratum, wherein the one or more excitation devices include one or more linear actuators;

compacting the stratum with vibratory energy created by the linear excitation; and propelling and steering the compactor with the vibratory energy by controlling a pitch angle of the linear excitation of at least one of the one or more excitation devices relative to the at least one contact plate.

20. The method of claim 19, wherein linearly actuating the one or more excitation devices includes linearly oscillating a mass associated with a crankshaft.

21. The method of claim 19, wherein linearly actuating the one or more excitation devices includes operating one or more electromagnetic actuators.

22. The method of claim 19, further including completely compacting the stratum in a single pass.

23. The method of claim 19, further including determining whether a predetermined amount of compaction has been achieved by monitoring acceleration of the at least one contact plate.

24. The method of claim 19, further including controlling at least one of a frequency and an amplitude of the excitation generated by the one or more excitation devices.

25. The method of claim 19, further including independently controlling at least two excitation devices for at least one of frequency, amplitude, and phase.

26. The method of claim 19, further including independently exciting two or more separate contact plates, each individually excitable by one or more excitation devices.

27. The method of claim 19, further including controlling operation of the compaction device using controls associated with a paving machine.

28. The method of claim 19, further including counter-rotating eccentric weights to generate the linear excitation.

29. A vibratory plate compactor, comprising:

at least one contact plate configured to be vibrated;

at least one excitation device configured to vibrate the at least one contact plate by linearly exciting the at least one contact plate to compact material beneath the at least one contact plate, propel the compactor, and steer the compactor;

the at least one excitation device being configured to propel and steer the compactor by varying a pitch angle between an axis of linear excitation and a plane including the at least one contact plate;

a power system configured to supply power to the at least one excitation device; and a controller configured to control a frequency and an amplitude of the linear excitation generated by the at least one excitation device and the pitch angle of the linear excitation;

wherein the at least one excitation device includes one or more linear actuators, the linear actuators including linearly oscillating masses and crankshafts associated with the linearly oscillating masses.

30. The compactor of claim 29, wherein the at least one contact plate includes two or more separate plates.

31. The compactor of claim 29, wherein the at least one excitation device includes two or more excitation devices.

32. The compactor of claim 29, wherein at least two of the two or more excitation devices are configured to generate linear excitation of a common contact plate.

33. The compactor of claim 29, wherein the at least one excitation device includes counter-rotating eccentric weights.

34. A vibratory plate compactor, comprising:

at least one contact configured to be vibrated;

one or more excitation devices configured to vibrate the at least one contact plate; and a power system configured to supply power to the one or more excitation devices;

the one or more excitation devices being configured to generate linear excitation of the at least one contact plate to compact material beneath the at least one contact plate, propel the compactor, and steer the compactor;

wherein a pitch angle of at least one of the one or more excitation devices between an axis of linear excitation and the at least one contact plate is variable to propel and steer the compactor.

35. The compactor of claim 34, wherein the one or more excitation devices include one or more linear actuators.

* * * * *

UNITED STATES PATENT AND TRADEMARK OFFICE

CERTIFICATE OF CORRECTION

PATENT NO. : 7,354,221 B2
APPLICATION NO. : 11/067275
DATED : April 8, 2008
INVENTOR(S) : Congdon It is certified that error appears in the above-identified patent and that said Letters Patent is hereby corrected as shown below:

Please correct the specification as follows:
Column 8, lines 10–17, delete "Certain embodiments may …….feet or more." and insert the same as continuation of paragraph in line 9 after "a worksite.".

Please correct the claims as follows:
Column 11, line 3, in claim 32, delete "claim 29," and insert -- claim 31, --.

Column 11, line 10, in claim 34, after "one contact" insert -- plate --.

Signed and Sealed this

Fourth Day of November, 2008

JON W. DUDAS
*Director of the United States Patent and Trademark Office*